US005619549A

United States Patent [19]

Vetter et al.

[11] Patent Number: 5,619,549

[45] Date of Patent: Apr. 8, 1997

[54] ROTARY-ANODE X-RAY TUBE COMPRISING A SLEEVE BEARING

[75] Inventors: Axel Vetter; Christoph Bathe, both of Hamburg, Germany

[73] Assignee: U.S. Philips Corporation, New York, N.Y.

[21] Appl. No.: 552,404

[22] Filed: Nov. 3, 1995

[30] Foreign Application Priority Data

Nov. 3, 1994 [DE] Germany ..... 44 39 143.9

[51] Int. Cl.[6] ..... H01J 35/10

[52] U.S. Cl. ..... 378/133; 378/132

[58] Field of Search ..... 378/132, 133

[56] References Cited

U.S. PATENT DOCUMENTS

| | | | |
|---|---|---|---|
| 3,427,244 | 2/1969 | Boes . | |
| 5,077,775 | 12/1991 | Vetter | 378/132 |
| 5,381,456 | 1/1995 | Vetter et al. | 378/132 |

FOREIGN PATENT DOCUMENTS

| | | |
|---|---|---|
| 0216278 | 4/1987 | European Pat. Off. . |
| 0378274 | 7/1990 | European Pat. Off. . |
| 0578314 | 1/1994 | European Pat. Off. . |

OTHER PUBLICATIONS

"The Place of Oilless Bearings in Industry" C.D. Spadone, The Engineers Digest, 16, Jan. 1995 pp. 14–16.

"Fullerenes" Robert Curl et al, Scientific American, Oct., 1991, pp. 32–41.

*Primary Examiner*—Craig E. Church

*Attorney, Agent, or Firm*—Jack D. Slobod

[57] ABSTRACT

A rotary-anode X-ray tube including a sleeve bearing with a stationary and a rotatable bearing portion having facing bearing faces, at least one of which is provided with a groove pattern, has a lubricant which is liquid at least in the operating condition present between the bearing faces. A reduction of bearing wear is achieved by addition of a solid having a low sliding friction to the lubricant.

20 Claims, 1 Drawing Sheet

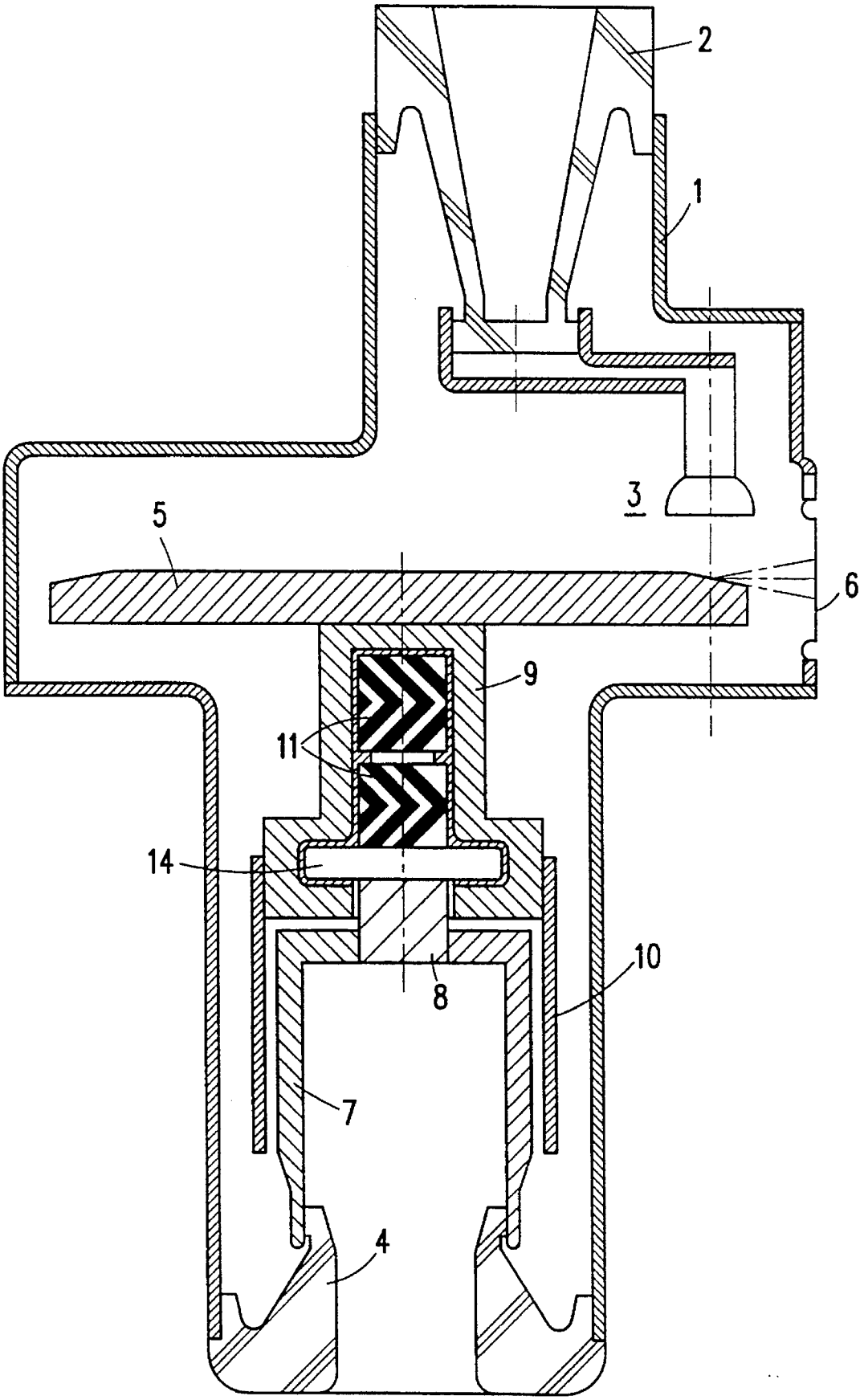
2
1
3
5
6
9
11
14
10
8
7
4

ROTARY-ANODE X-RAY TUBE COMPRISING A SLEEVE BEARING

BACKGROUND OF THE INVENTION

1. Field of the Invention

The invention relates to a rotary-anode X-ray tube comprising a sleeve bearing with a stationary and a rotatable bearing portion provided with facing bearing faces, at least one of which is provided with a groove pattern, a lubricant which is liquid at least in the operating condition being present between said bearing faces.

2. Description of the Related Art

A rotary-anode X-ray tube of this kind is known from EP-OS 578 314 (U.S. Pat. No. 5,381,456) or from EP-OS 378 274 (U.S. Pat. No. 5,077,775). During rotation of the rotary anode, the lubricant is distributed in the groove pattern in such a manner that a hydrodynamic lubricant film is formed and the two bearing portions "float" on one another. The bearing then operates substantially without wear.

Even though gallium alloys which are generally used as the lubricant in rotary-anode X-ray tubes of this kind have very good lubricating properties, nevertheless wear of the bearing faces may occur, notably when the lubricant is extensively pressed out of the region of the groove pattern after a prolonged period of standstill of the rotary anode or after deceleration of the bearing at high temperatures (or a low lubricant viscosity).

SUMMARY OF THE INVENTION

It is an object of the present invention to reduce such wear. This object is achieved in accordance with the invention in that a solid having a low sliding friction is added to the lubricant.

During normal operatic, n, i.e. during rotation of the sleeve bearing, the solid additive is practically inactive. Upon starting and stopping of the sleeve bearing, however, the solid separates the bearing faces from one another, thus reducing the bearing wear.

Any dry lubricant which reacts neither with the bearing faces nor with the lubricant, which reduces the sliding friction coefficient between the bearing faces, and which does not influence the vacuum in the X-ray tube can in principle be used as the solid.

In a further embodiment of the invention, the solid content is between 0.05 and 5% by weight, preferably between 0.1 and 2% by weight and notably between 0.3 and 1% by weight. It is advisable to choose the solid content between the stated limits; if the content is less, the effectiveness will be less and if the content is higher, the groove pattern could be clogged by the solid.

BRIEF DESCRIPTION OF THE DRAWING

The invention will be described in detail hereinafter with reference to a drawing consisting of a single figure which shows a rotary-grade X-ray tube in accordance with the invention.

DETAILED DESCRIPTION OF THE PREFERRED EMBODIMENT

The rotary-anode X-ray tube shown in the drawing comprises a metal envelope 1 whereto a cathode 3 is connected via a first insulator 2 and whereto a rotary anode is connected via a second insulator 4. The rotary anode comprises an anode disc 5 on whose side which faces the cathode 3 X-rays are generated when a high voltage is switched on. The X-rays can emanate from the envelope through a radiation exit window 6 which preferably consists of beryllium. The anode disc 5 is connected, via a sleeve bearing, to a supporting member 7 which is connected to the second insulator 4. The sleeve bearing comprises a bearing shaft 8 which is rigidly connected to the supporting member 7 and a bearing shell 9 which concentrically encloses the bearing shaft 8 and at the lower end of which there is provided a rotor 10 for driving the anode disc 5 connected to the upper end.

The bearing shaft 8 and the bearing shell 9 are made of a molybdenum alloy (TZM). Instead, however, use can be made of molybdenum or a tungsten-molybdenum alloy. In the configuration shown, the bearing shaft 8 constitutes the stationary bearing portion and the bearing shell 9 constitutes the rotating bearing portion; evidently, the invention can be applied equally well to sleeve bearing configurations in which the bearing shaft rotates and the bearing shell is stationary.

At its upper end the bearing shaft 8 is provided with two groove patterns 11 which are offset relative to one another in the axial direction and which serve to take up radial forces. Adjacent to the groove patterns the bearing shaft 8 comprises a section 14 which has a length of several millimeters and whose diameter is substantially greater than the diameter of the remainder of the bearing shaft 8. This section is succeeded by a section whose diameter corresponds at least approximately to the diameter of the upper section of the bearing shaft 8 and which is connected to the supporting member 7. The inner contour of the bearing shell is adapted to the section 14.

The free end faces at the top and the bottom of the section 14 are provided with a groove pattern which is composed of pairs of grooves extending towards one another. The course of the grooves preferably extend as the curved segments of two oppositely directed logarithmic spirals. Forces acting in the axial direction can thus be taken up.

The gap between the bearing shaft 8 and the bearing shell 9 is filled, at least at the area of the groove pattern, with a liquid lubricant which is preferably a gallium alloy. The width of the gap may correspond to the depth of the grooves and amount to from 10 μm to 30 μm in practice. When the rotary anode rotates in the specified direction of rotation, the lubricant is transported to the area of the groove pattern where the grooves meet pair-wise. At that area a pressure is built up in the lubricant, which pressure is capable of taking up forces acting radially or axially on the bearing, the bearing shell 9 "floats" on the bearing shaft 8 in this condition.

In accordance with the invention, a solid which reduces the friction between the bearing shell 9 and the bearing shaft during starting and stopping operations is added to the lubricant. Some lubricant additives which are suitable in this respect are given hereinafter:

a) tungsten diselenite ($WSe_2$) or tantalum diselenite ($TaSe_2$). These solids prevent wear in that because of their laminar crystal structure between the bearing portions internal shear occurs under the influence of the tangentially acting shearing forces.

b) molybdenum disulphide. The mechanism corresponds to that of the selenite stated sub a). The addition of molybdenum sulphide reduces the sliding coefficient between non-lubricated TZM or molybdenum bearing faces to less than one tenth of its value in the absence of this solid.

The attractive lubricating properties of the additives mentioned sub a) and b) are known. For example, U.S. Pat. No. 3,427,244 describes a self-lubricating member which is made of a sintered mixture (hardened under pressure and temperature) of three components: from 10 to 30% by weight of a gallium alloy, from 90 to 70% by weight of a solid lubricant which is formed by a sulphide or a selenite of tungsten or molybdenum, and a filler agent consisting of a metal powder.

c) monodisperse oxide particles. There are, for example particles of silicon dioxide ($SiO_2$). The manufacture of these particles, marketed by the firm Ernst Merck, is described in EP-PS 216 278. These particles are shaped as spheres whose mean diameter may amount to from 10 to 2000 nm, depending on the choice of the parameters of the manufacturing process. Upon starting or stopping these microspheres are present between the bearing faces of the bearing portions 8, 9 which slide relative to one another, so that these portions roll one on the other.

d) fullerenes. The fullerenes known from the magazine "Scientific American", October 1991, pp. 32 to 41, have a spherical shape when they consist of $C_{60}$ molecules. Therefore, in respect of the friction between the bearing portions the mechanism is similar to that occurring for the monodisperse particles.

When the contents of the solid in the lubricant/solid mixture is between 0.05 and 5% by weight, acceptable results are obtained; good results are obtained when the solid content is between 0.1 and 2% by weight and optimum results are obtained when the content is between 0.3 and 1% by weight. In the case of smaller contents, only a limited effect will be obtained and in the case of higher contents there is a risk of clogging of the grooves of the groove pattern by the solid, so that the operation of the beating in the normal operating condition (with a rotating rotary anode) could be affected.

We claim:

1. A rotary-anode X-ray tube, comprising a sleeve bearing with a stationary and a rotatable bearing portion provided with facing bearing faces, at least one of which is provided with a groove pattern, a lubricant which is liquid at least in the operating condition being present between said bearing faces, characterized in that a solid having a low sliding friction is added to the lubricant.

2. A rotary-anode X-ray tube as claimed in claim 1, characterized in that a gallium alloy is used as the lubricant.

3. A rotary-anode X-ray tube as claimed in claim 1, characterized in that the solid consists of tungsten diselenite or tantalum diselenite.

4. A rotary-anode X-ray tube as claimed in claim 1, characterized in that the solid consists of molybdenum disulphide.

5. A rotary-anode X-ray tube as claimed in claim 1, characterize in that the solid consists of monodisperse oxide particles.

6. A rotary-anode X-ray tube as claimed in claim 1, characterized in that the solid consists of fullerenes.

7. A rotary-anode X-ray tube as claimed in claim 1, characterized in that the solid content is between 0.05 and 5% by weight, preferably between 0.1 and 2% by weight, and notably between 0.3 and 1% by weight.

8. A rotary-anode X-ray tube as claimed in claim 2, characterized in that the solid consists of tungsten diselenite or tantalum diselenite.

9. A rotary-anode X-ray tube as claimed in claim 2, characterized in that the solid consists of molybdenum disulphide.

10. A rotary-anode X-ray tube as claimed in claim 2, characterized in that he solid consists of monodisperse oxide particles.

11. A rotary-anode X-ray tube as claimed in claim 2, characterized in that the solid consists of fullerenes.

12. A rotary-anode X-ray tube as claimed in claim 2, characterized in that the solid content is between 0.05 and 5% by weight, preferably between 0.1 and 2% by weight, and notably between 0.3 and 1% by weight.

13. A rotary-anode X-ray tube as claimed in claim 3, characterized in that the solid content, is between 0.05 and 5% by weight, preferably between 0.1 and 2% by weight, and notably between 0.3 and 1% by weight.

14. A rotary-anode X-ray tube as claimed in claim 4, characterized in that the solid content is between 0.05 and 5% by weight, preferably between 0.1 and 2% by weight, and notably between 0.3 and 1% by weight.

15. A rotary-anode X-ray tube as claimed in claim 5 characterized in that the solid content is between 0.05 and 5% by weight, preferably between 0.1 and 2% by weight, and notably between 0.3 and 1% by weight.

16. A rotary-anode X-ray tube as claimed in claim 6, characterized in that the solid content is between 0.05 and 5% by weight, preferably between 0.1 and 2% by weight, and notably between 0.3 and 1% by weight.

17. A rotary-anode X-ray tube as claimed in claim 8 characterized in that the solid content is between 0.05 and 5% by weight, preferably between 0.1 and 2% by weight, and notably between 0.3 and 1% by weight.

18. A rotary-anode X-ray tube as claimed in claim 9 characterized in that the solid content is between 0.05 and 5% by weight, preferably between 0.1 and 2% by weight, and notably between 0.3 and 1% by weight.

19. A rotary-anode X-ray tube as claimed in claim 10, characterized in that the solid content is between 0.05 and 5% by weight, preferably between 0.1 and 2% by weight, and notably between 0.3 and 1% by eight.

20. A rotary-anode X-ray tube as claimed in claim 11, characterized in that the solid content is between 0.05 and 5% by weight, preferably between 0.1 and 2% by weight, and notably between 0.3 and 1% by weight.

* * * * *